US008201464B2

(12) United States Patent
Anjanappa et al.

(10) Patent No.: US 8,201,464 B2
(45) Date of Patent: Jun. 19, 2012

(54) ELECTRONIC TORQUE WRENCH WITH A MANUAL INPUT DEVICE

(76) Inventors: Muniswamappa Anjanappa, Ellicott City, MD (US); Awad Aly Gharib, Cockeysville, MD (US); Xia Chen, Columbia, MD (US); Nitin Bedi, Houston, TX (US)

( * ) Notice: Subject to any disclaimer, the term of this patent is extended or adjusted under 35 U.S.C. 154(b) by 364 days.

(21) Appl. No.: 12/552,439

(22) Filed: Sep. 2, 2009

(65) Prior Publication Data

US 2010/0050828 A1 Mar. 4, 2010

Related U.S. Application Data

(60) Provisional application No. 61/093,658, filed on Sep. 2, 2008.

(51) Int. Cl.
*B25B 23/14* (2006.01)

(52) U.S. Cl. ..... 73/862.21

(58) Field of Classification Search ..... 73/760, 73/862.08, 862.21
See application file for complete search history.

(56) References Cited

U.S. PATENT DOCUMENTS

| | | | | |
|---|---|---|---|---|
| 2,682,796 | A | 7/1954 | Larson | |
| 2,732,747 | A | 1/1956 | Livermont | |
| 3,847,038 | A | 11/1974 | Green | |
| 3,995,477 | A | 12/1976 | Almond | |
| 4,244,434 | A | 1/1981 | Wilson | |
| 4,290,329 | A | 9/1981 | Green | |
| 4,397,196 | A | 8/1983 | Lemelson | |
| 4,485,703 | A | 12/1984 | Grabovac et al. | |
| 4,562,746 | A * | 1/1986 | Petit | 73/862.23 |
| 4,664,001 | A | 5/1987 | Denman | |
| 4,669,319 | A | 6/1987 | Heyraud | |
| 4,958,541 | A | 9/1990 | Annis et al. | |
| 4,982,612 | A | 1/1991 | Rittmann | |
| 5,156,072 | A | 10/1992 | Muralidharan | |
| 5,224,403 | A | 7/1993 | Rueb | |
| 5,421,240 | A * | 6/1995 | Ohta et al. | 91/59 |
| 5,557,994 | A | 9/1996 | Nakayama | |
| 6,070,506 | A | 6/2000 | Becker | |
| 6,463,811 | B1 | 10/2002 | Putney | |
| 6,526,853 | B2 | 3/2003 | Jenkins | |
| 6,568,283 | B2 | 5/2003 | Fanguy | |
| 6,722,235 | B2 | 4/2004 | Hsieh | |
| 6,981,436 | B2 | 1/2006 | Becker et al. | |
| 7,000,508 | B2 | 2/2006 | Li et al. | |
| 7,044,036 | B1 | 5/2006 | Salazar et al. | |
| 7,047,849 | B2 | 5/2006 | Lai | |
| 7,107,884 | B2 | 9/2006 | Cutler et al. | |
| 7,735,398 | B2 * | 6/2010 | Hsu et al. | 81/57.39 |
| 7,878,076 | B2 * | 2/2011 | Lucke et al. | 73/862.23 |

FOREIGN PATENT DOCUMENTS

FR 2633544 1/1990

* cited by examiner

*Primary Examiner* — Max Noori
(74) *Attorney, Agent, or Firm* — Nelson Mullins Riley & Scarborough, LLP

(57) ABSTRACT

A torque wrench including a handle attached to a drive member and a transducer that senses the torque transferred from the handle to the drive member and outputs a first signal corresponding to the transferred torque. An analog mechanical input device disposed on the handle that simultaneously defines a set point and indicates the set point. A comparator receives the first signal from the transducer, receives the set point, compares the first signal from the transducer to the set point, and outputs a second signal. The mechanical input device does not display a real time measurement of the torque transferred to the work piece prior to reaching the set point.

11 Claims, 12 Drawing Sheets

ELECTRONIC TORQUE WRENCH WITH A MANUAL INPUT DEVICE

CLAIM OF PRIORITY

This application claims priority to U.S. Provisional Patent Application No. 61/093,658, filed Sep. 2, 2008, entitled "Electronic Torque Wrench With A Manual Input Device," the entire disclosure of which is incorporated by reference herein.

FIELD OF THE INVENTION

The present invention relates generally to torque application and measurement devices. More particularly, the present invention relates to an input device for manually selecting a set point torque value for an electronic torque wrench.

BACKGROUND OF THE INVENTION

Often, fasteners used to assemble performance critical components are tightened to a specified torque level to introduce a "pretension" in the fastener. As torque is applied to the head of the fastener, beyond a certain level of torque the fastener begins to stretch. This stretch results in the pretension in the fastener which then holds the components together. A popular method of tightening these fasteners is to use a torque wrench. Accurate and reliable torque wrenches help insure the fasteners are tightened to the proper torque specifications.

Torque wrenches vary from simple mechanical types to sophisticated electronic types. Mechanical type torque wrenches are generally less expensive than electronic ones. There are two common types of mechanical torque wrenches, beam and clicker types. With a beam type torque wrench, a beam bends relative to a non-deflecting beam in response to the torque being applied with the wrench. The amount of deflection of the bending beam relative to the non-deflecting beam indicates the amount of torque applied to the fastener. Clicker type torque wrenches work by preloading a snap mechanism with a spring to release at a specified torque, thereby generating a click noise.

Electronic torque wrenches (ETWs) are typically more accurate than mechanical torque wrenches, but they tend to be more expensive than mechanical torque wrenches and less rugged in their construction. Typically, when applying torque to a fastener with an electronic torque wrench, the torque readings indicated on the display device of the electronic torque wrench are proportional to the pretension in the fastener due to the applied torque. Because the display devices on electronic torque wrenches often include liquid crystal displays, or similar devices, they are often the "weak link" of the torque wrenches construction.

Drawbacks present in prior art electronic torque wrenches may leave them susceptible to being easily damaged through normal usage and, subsequently, may lead to the over or under-torquing of fasteners, which can contribute to reduced performance, and eventual failure, of the fasteners.

The present invention recognizes and addresses the foregoing considerations, and others, of prior art constructions and methods.

SUMMARY OF THE INVENTION

One embodiment of the present invention provides a torque wrench including a drive member with a surface configured to attach to a work piece to transfer torque to the work piece and a handle attached to the drive member so that force applied to the handle transfers torque to the drive member. A transducer is disposed operatively between the handle and the drive member so that the transducer senses the torque transferred from the handle to the drive member and outputs a first signal corresponding to the transferred torque sensed by the transducer. An analog mechanical input device is disposed on the handle that simultaneously defines a set point and indicates the set point. A comparator receives the first signal from the transducer, receives the set point, compares the first signal from the transducer to the set point, and outputs a second signal based on a predetermined relationship between the first signal and the set point. A detection mechanism receives the second signal from the comparator and generates a human recognizable output in response to the second signal. The mechanical input device does not display a real time measurement of the torque transferred to the work piece prior to reaching the set point.

Another embodiment of the present invention provides a torque wrench including a drive member with a surface configured to attach to a work piece to transfer torque to the work piece and a handle attached to the drive member so that force applied to the handle transfers torque to the drive member. A transducer is disposed operatively between the handle and the drive member so that the transducer senses the torque transferred from the handle to the drive member and outputs a first signal corresponding to the transferred torque sensed by the transducer. A variable output circuit outputs a set point signal corresponding to a desired set point and includes a hand-actuable control that simultaneously defines the set point signal and indicates the desired set point. A comparator receives the first signal from the transducer, receives the set point signal, compares the first signal from the transducer to the set point signal, and outputs a second signal based on a predetermined relationship between the first signal and the set point signal. A detection mechanism receives the second signal from the comparator and generates a human recognizable output in response to the second signal.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
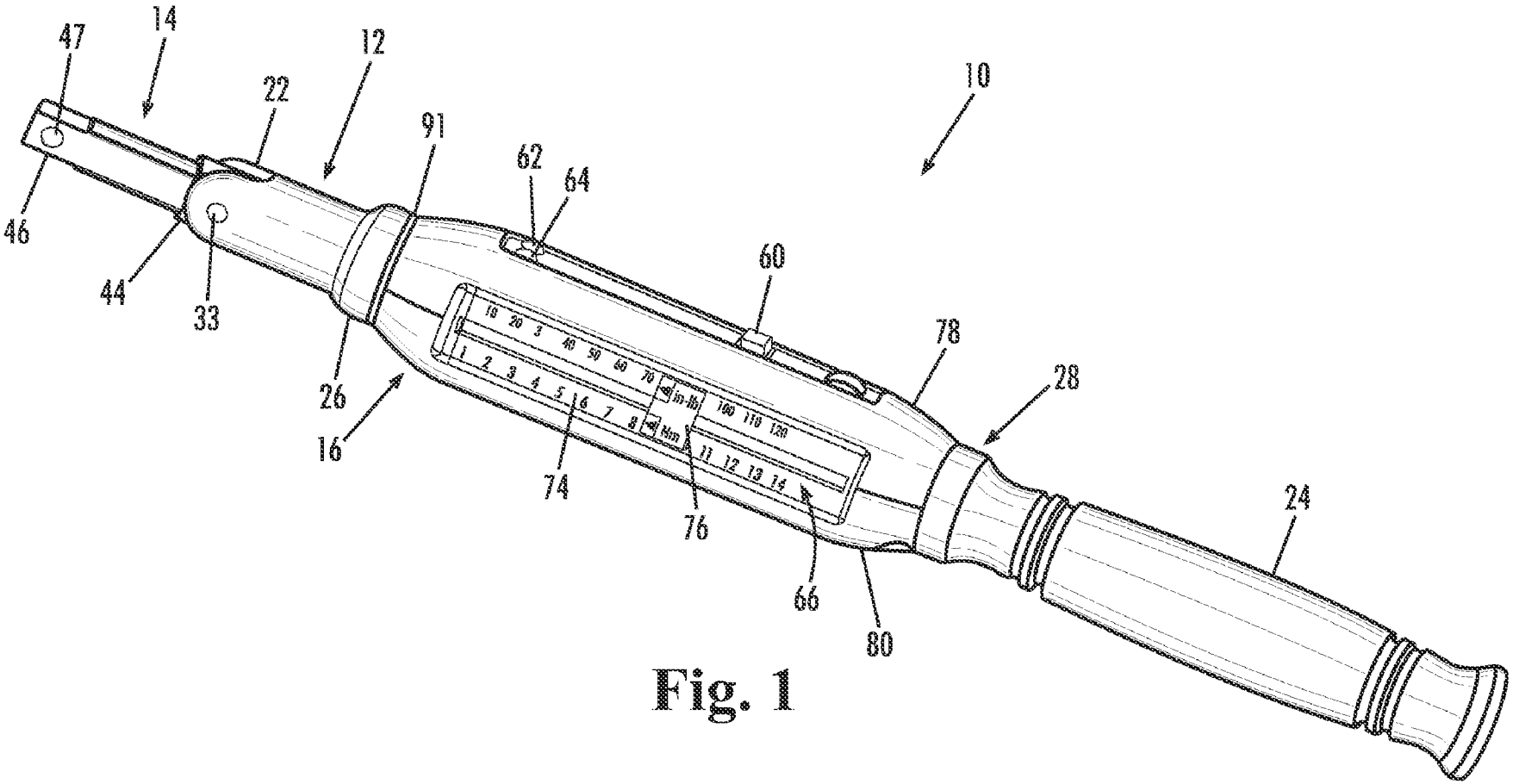
FIG. 1 is a perspective view of a preferred embodiment of an electronic torque wrench in accordance with the present invention.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to FIGS. 1 through 6, an electronic torque wrench 10 including an analog mechanical input device in accordance with the present invention is shown. Electronic torque wrench 10 includes a wrench body 12, a drive member 14, a housing 16, and an electronics unit 18 with a user interface. Preferably, wrench body 12 is of unitary construction, made of steel or other rigid material, and pivotably receives drive member 14 at a first end and a grip handle 24 at a second end. Housing 16 is mounted therebetween and carries electronics unit 18. As shown, a yoke 22 is formed at the first end of wrench body 12, yoke 22 defining a pair of mounting apertures 32 that are configured to receive a mounting pin 33 therein, thereby forming a pivot joint. A detent 34 including a ball and a biasing spring is received in an aperture (not shown) that is formed in a front face of body 12 between the arms of yoke 22. A central portion 30 of wrench body 12 is disposed between a front flange 26 and a rear flange 28 of the body. Central portion 30 includes a rectangular cross-section defined by a top wall 36, a bottom wall 38, and a pair of substantially parallel opposed side walls 40. The cross-sectional dimensions of central portion 30 are selected dependent upon the desired amount of flexural movement of the central portion over the operating range of the torque wrench.

A strain gauge assembly 42 is disposed on one of opposed side walls 40 and is connected to electronics unit 18 by a wire set 43 that is similarly disposed on the corresponding side wall 40. In the preferred embodiment, the strain gauge assembly is a full-bridge assembly including four (4) separate strain gauges on a single film that is secured to the desired side wall 40. An example of one such full-bridge strain gauge assembly is Model No. N2A-S1449-1KB manufactured by Vishay Micromeasurement. Together, the full-bridge strain gauge assembly mounted on side wall 40 of wrench body 12 is referred to as a strain tensor.

Figure 3A:
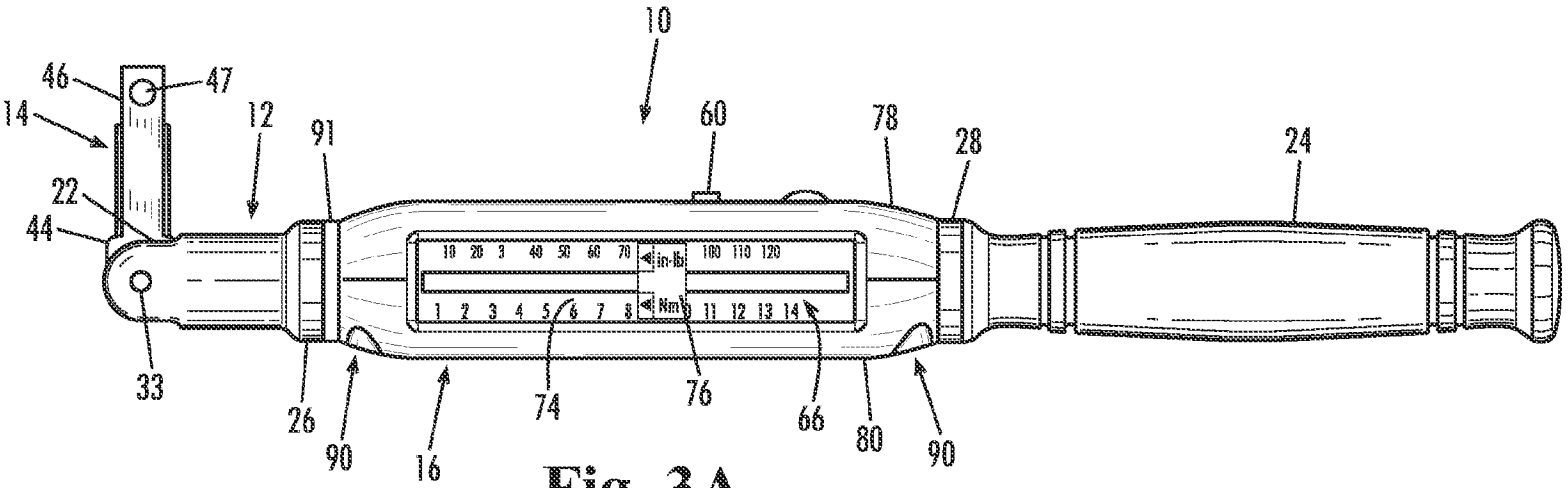
FIGS. 3A and 3B are left side and right side plan views of the electronic torque wrench shown in FIG. 1.
Figure 3B:
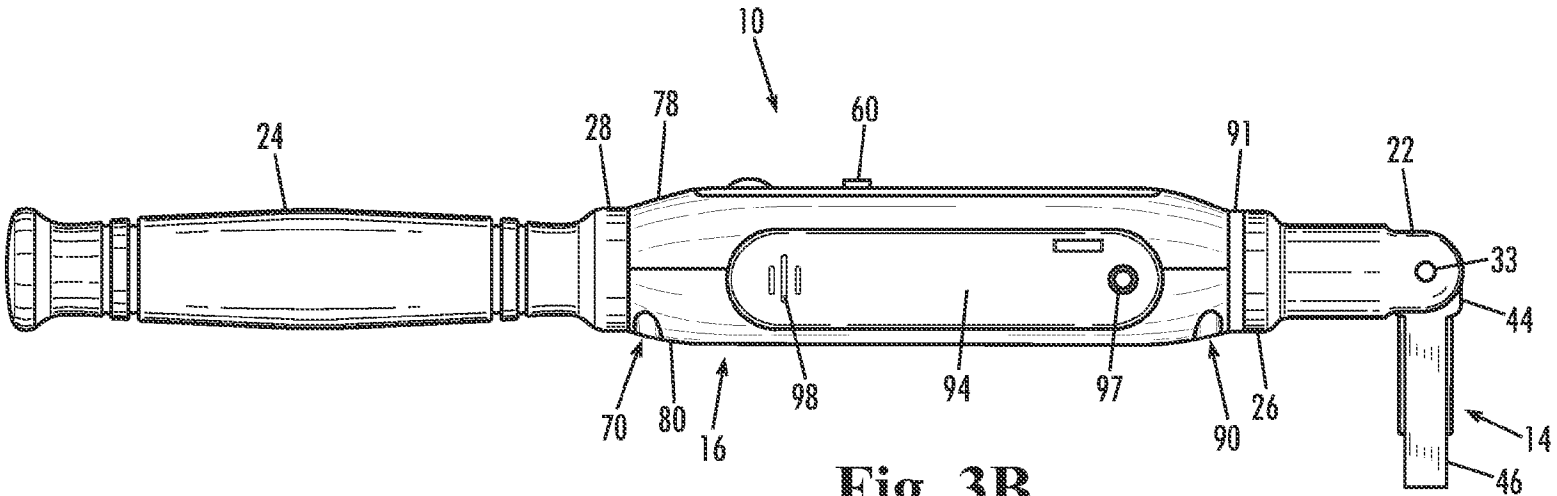
Figure 4A:
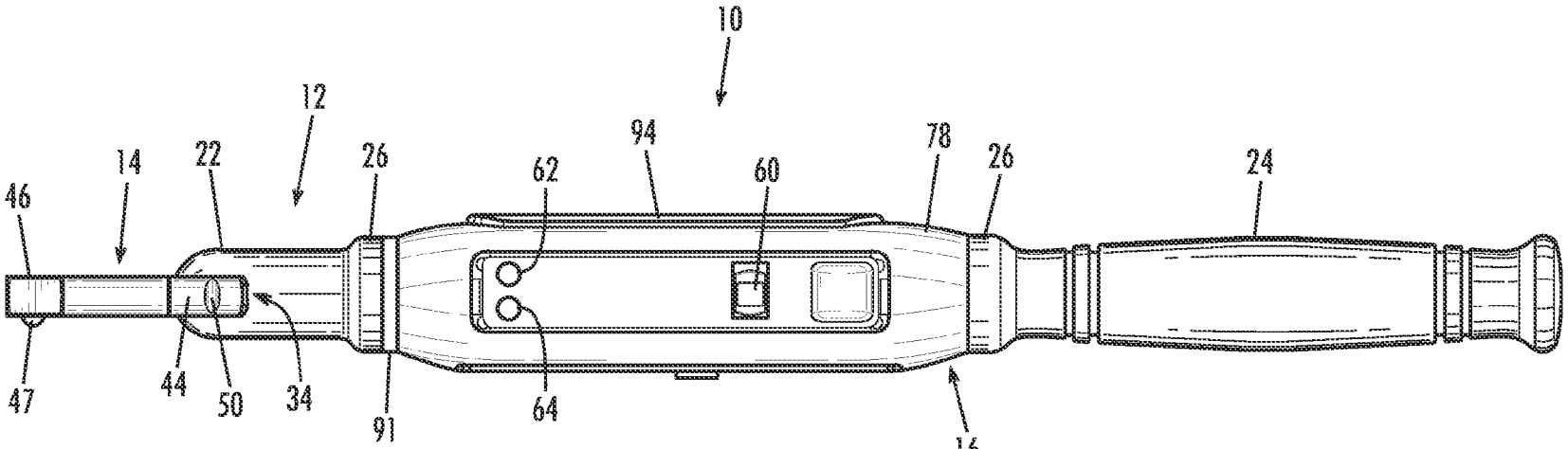
FIGS. 4A and 4B are top and bottom plan views, respectively, of the electronic torque wrench shown in FIG. 1.
Figure 4B:
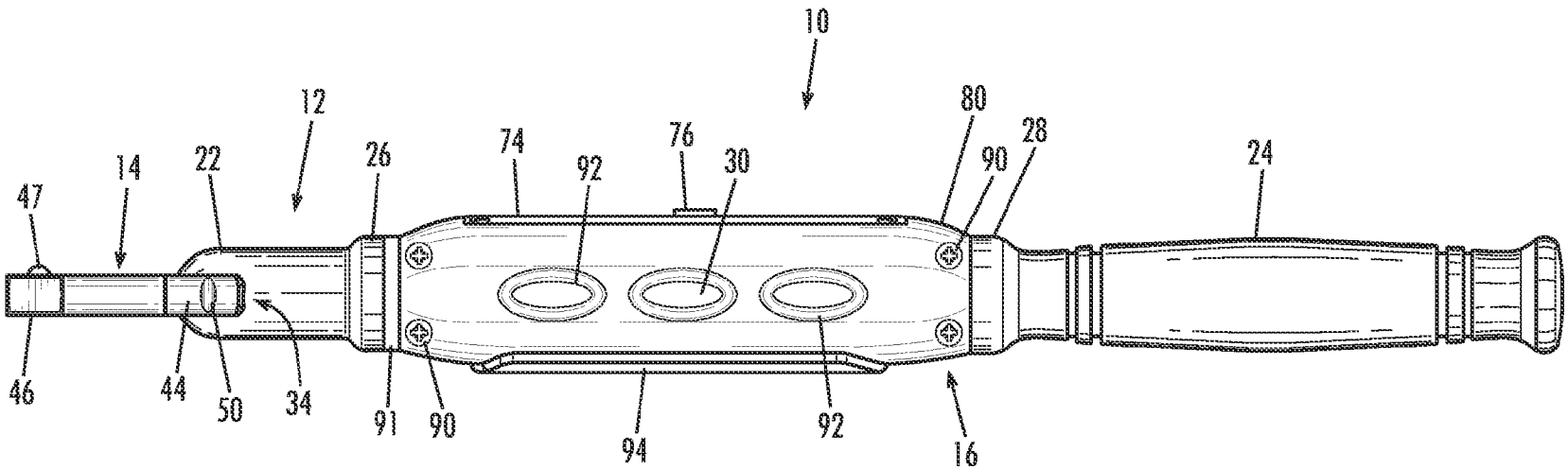
Figure 5:
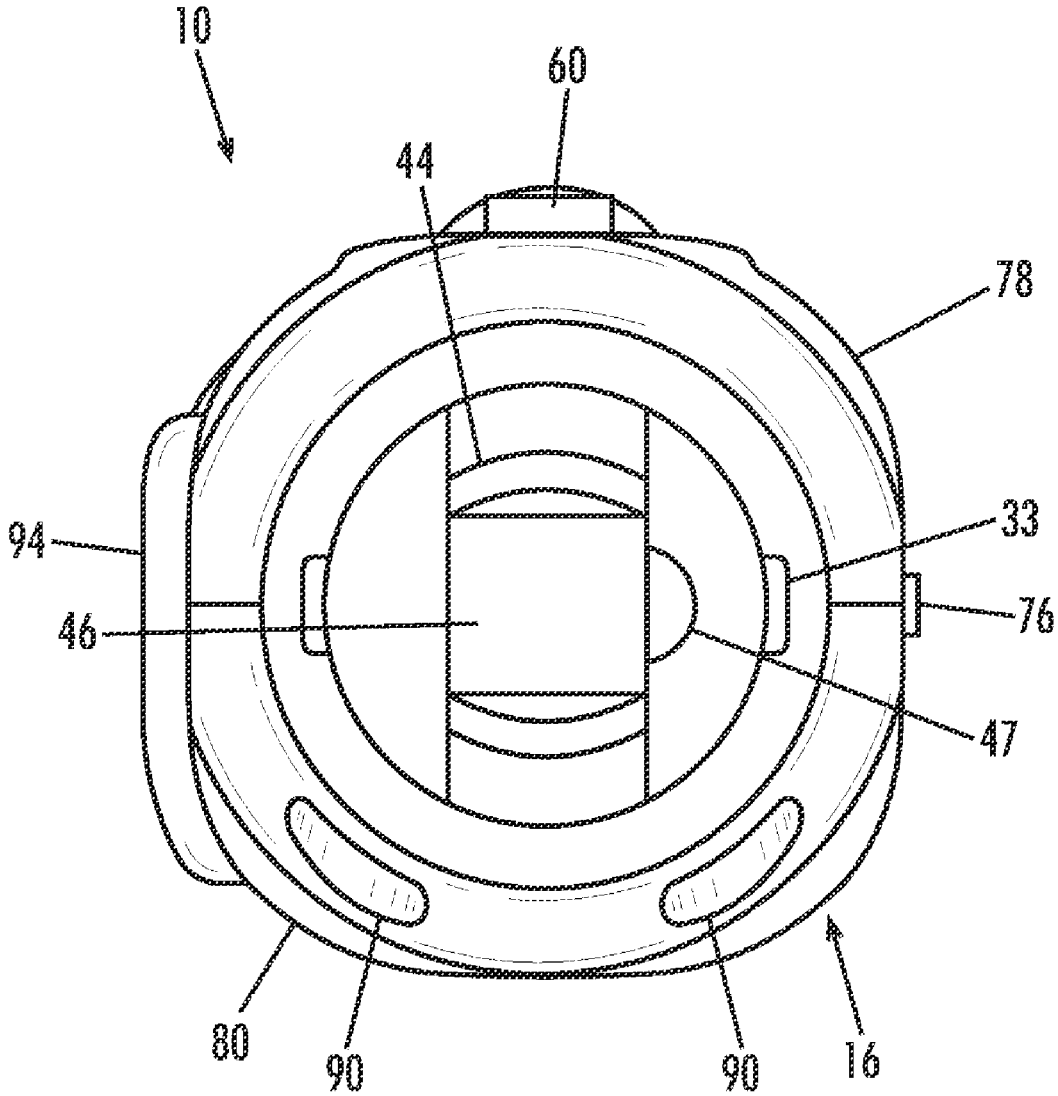
FIG. 5 is a front plan view of the electronic torque wrench shown in FIG. 1.

As shown, yoke 22 of wrench body 12 pivotably receives drive member 14. Drive member 14 includes a body 44 at a first end and a boss 46 at a second end. Body 44 defines a mounting aperture 48 therethrough that corresponds to mounting apertures 32 defined by yoke 22. Drive member 14 is pivotably mounted to yoke 22 by passing mounting pin 33 through aligned mounting apertures 32 and 48. A plurality of transverse grooves 50 are formed about the outer surface of body 44 and are configured to selectively receive detent 34 that projects outwardly from body 12. As shown, three transverse grooves 50 are formed in body 44 such that drive member 14 can be selectively secured either in alignment with the longitudinal axis of body 12 (as shown in FIG. 1) or in one of two positions in which drive member 14 is transverse to the longitudinal axis of wrench body 12 (as shown in FIGS. 3A and 3B). Boss 46 of drive member 14 is configured to receive variously sized sockets, extensions, etc., and includes a detent 47 to assist in maintaining the desired fitting on boss 46.

Housing 16 includes a top portion 78 and a bottom portion 80 that are received about central portion 30 of wrench body 12 and house electronics unit 18. Electronics unit 18 provides a user interface for the operation of electronic torque wrench 10. Electronics unit 18 includes a first printed circuit board 52 that is configured to receive a plurality of batteries 54 (FIG. 6) and has an annunciator 56 mounted thereon. Electronics unit 18 also includes a second printed circuit board 58 including two light-emitting diodes (LEDs) 62 and 64 and a power button 59 that is operated by a switch 60. LEDs 62 and 64 are green and red, respectively, when activated. The user interface also includes an analog mechanical input device for simultaneously defining and indicating a set point torque value, as discussed in greater detail below. In the preferred embodiment shown, the mechanical input device is a resistive element assembly 66 that includes a resistive element 68, a graduated panel 74 and a manually operated input slider 76.

Figure 7:
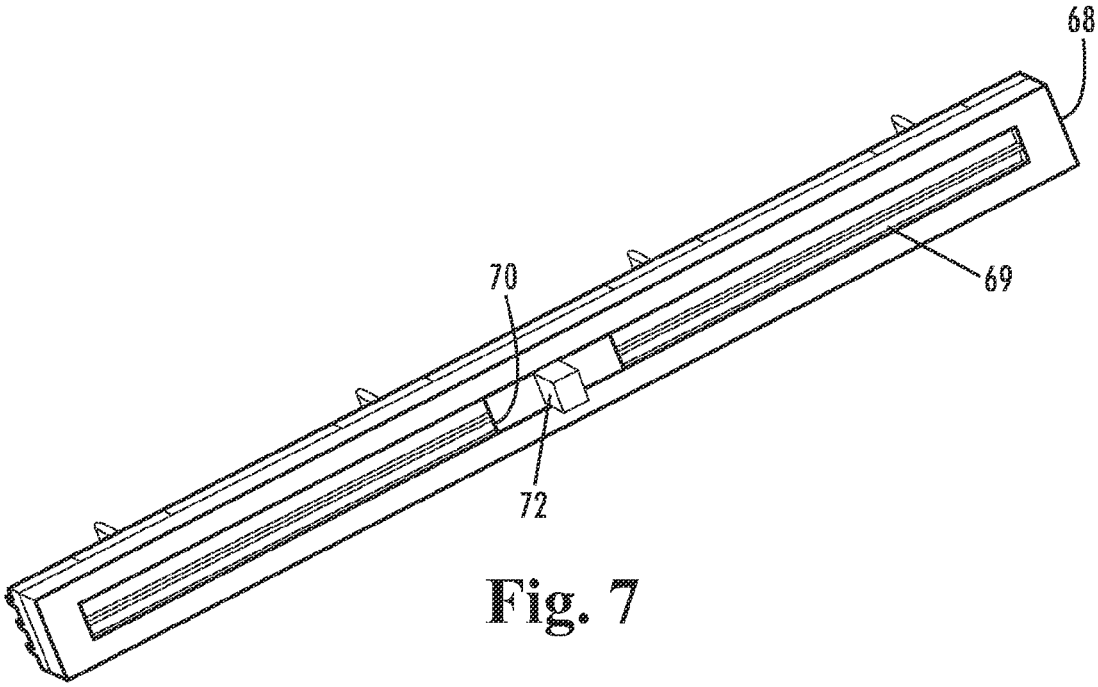
FIG. 7 is a perspective view of a resistive element of the electronic torque wrench as shown in FIG. 1.

Referring additionally to FIG. 7, in the preferred embodiment shown, the resistive element is a sliding potentiometer that includes a linear resistor 69, a wiper assembly 70 configured for motion along linear resistor 69, and an adjustment pin 72 extending outwardly from wiper assembly 70. Terminal leads are provided for receiving wires from electronics unit 18. The motion of wiper assembly 70 along linear resistor 69 causes the overall resistance of sliding potentiometer 68 to vary, as discussed in greater detail below. As shown, graduated panel 74 includes two different sets of units disposed along its upper half and bottom half such that the user of electronic torque wrench 10 can select either of the sets of units when manually selecting the desired set point torque value with input slider 76. As shown, input slider 76 indicates that the upper set of units are in inch-pounds whereas the lower set of units are Newton-meters. Note, however, various other sets of units can be utilized by merely replacing the existing graduated panel 74 with a graduated panel including the desired sets of units.

Figure 2:
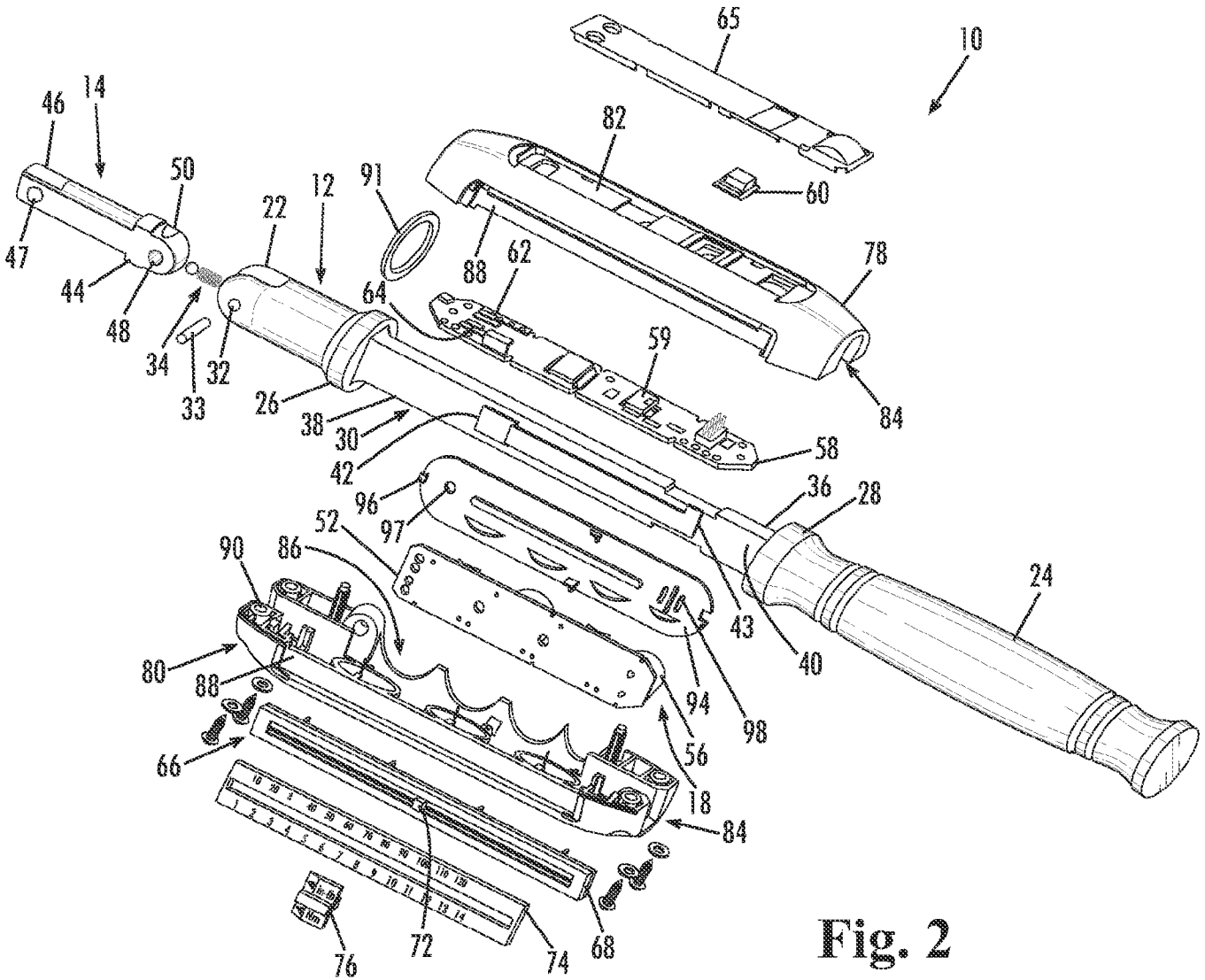
FIG. 2 is an exploded perspective view of the electronic torque wrench as shown in FIG. 1.
Figure 6:
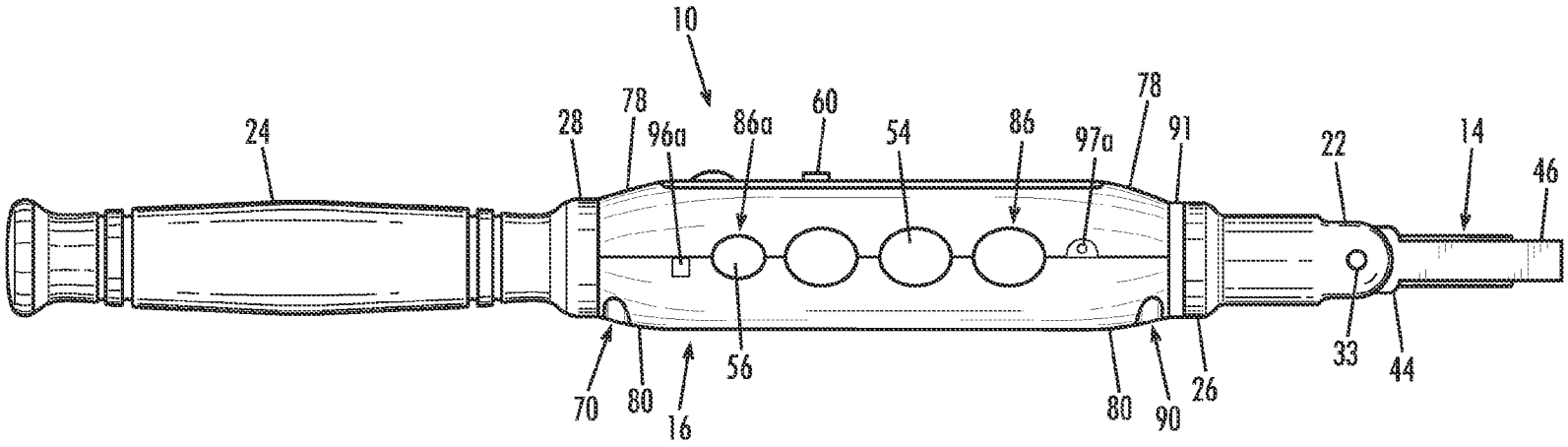
FIG. 6 is a side plan view of the electronic torque wrench as shown in FIG. 1 with the battery door removed.

As best seen in FIG. 2, electronics unit 18 is disposed on wrench body 12 between top portion 78 and bottom portion 80 of housing 16. Top portion 78 and bottom portion 80 each include a pair of longitudinal slots 84, a plurality of corresponding access apertures 86, corresponding input device recesses 88, and a plurality of corresponding fastener apertures 90. The corresponding pairs of longitudinal slots 84 are configured to slidably receive central portion 30 of wrench body 12 such that top portion 78 and bottom portion 80 of housing 16 are received between front and rear flanges 26 and 28 of wrench body 12. Threaded fasteners are received in corresponding fastener apertures 90 to secure the two portions of housing 16 in place. So connected, corresponding input device recesses 88 of top and bottom portion 78 and 80 form a single input device recess for receiving graduated panel 74 of resistive element assembly 66. Also, as best seen in FIG. 6, corresponding access apertures 86 form a plurality of apertures through which batteries 54 can be installed on first printed circuit board 52. Additionally, aperture 86*a* allows annunciator 56 that is disposed on first printed circuit board 52 to extend outwardly from housing 16 so that it may be more easily heard. Top portion 78 of housing defines recess 82 that is configured to receive a top plate 65 of the user interface.

A battery door 94 is removably secured to housing 16 so that batteries 54 are securely held within housing 16. Bottom portion 80 of housing 16 defines a door aperture 96*a* that is configured to receive an arm 96 that extends inwardly from a first end of battery door 94 and a fastener aperture 97*a* that is configured to receive a fastener that passes through a corresponding fastener aperture 97 on a second end of battery door 94. As best seen in FIG. 3B, battery door 94 defines a plurality of annunciator slots 98 that correspond to the position of annunciator 56 so that the annunciator can be more easily heard. Additionally, bottom portion 80 of housing 16 defines a plurality of apertures 92 (FIG. 4B) through which central portion 30 of wrench body 12 is visible. An O-ring 91 is disposed between front flange 26 of wrench body 12 and housing 16 to help keep dust, dirt, debris, etc., out of housing 16 while the electronic torque wrench 10 is in use.

Figure 8:
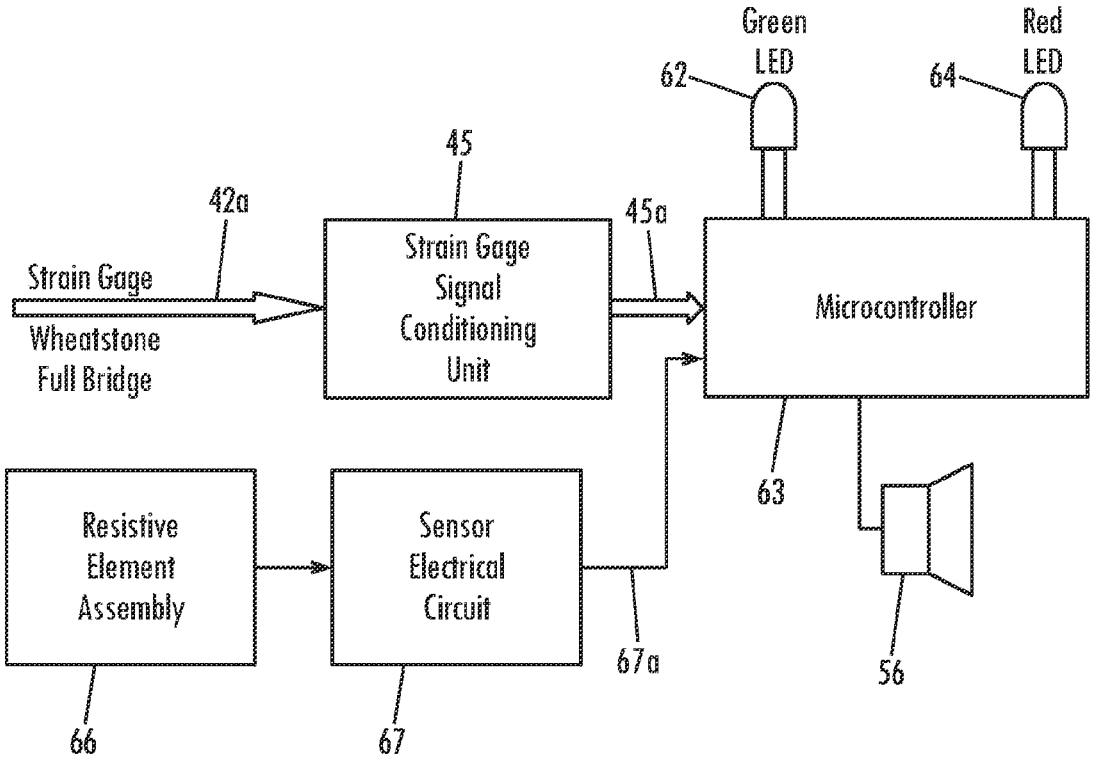
FIG. 8 is a block diagram representation of the electronic torque wrench as shown in FIG. 1.
Figure 9:
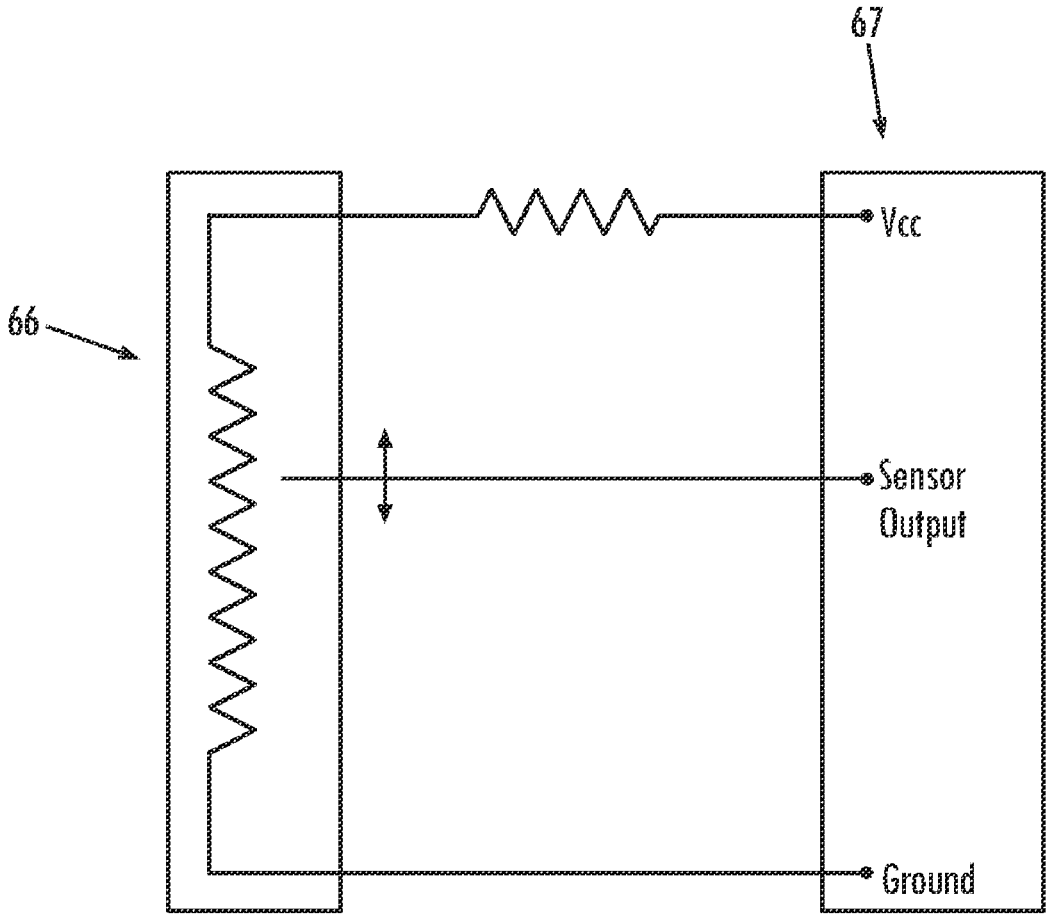
FIG. 9 is an electrical circuit diagram of the electronics unit of the electronic torque wrench as shown in FIG. 1.

A block diagram representation of the electronics unit of the preferred embodiment, showing various inputs and outputs, is shown in FIG. 8. Prior to using electronic torque wrench 10 to apply torque, a set point torque value is selected using the analog mechanical input device. Referring additionally to FIG. 9, a sensor electrical circuit 67 that determines the resistance of the resistive element of resistive element assembly 66 in order to create an electrical signal for use by the microcontroller, is shown. Sensor electrical circuit 67 provides a fixed DC excitation voltage (Vcc) in the range of three to five volts that corresponds to a base torque value for the torque wrench. The output voltage 67*a* of sensor electrical circuit 67 is proportional to the resistance of the resistive element of resistive element assembly 66. As input slider 76 (FIG. 1) is manipulated, the resistance of the resistive element changes, which in turn changes the output voltage 67*a* of sensor electrical circuit 67. Because the output voltage 67*a* is proportional to the resistance of the resistive element, it is also proportional to the desired set point torque value.

Figure 10A:
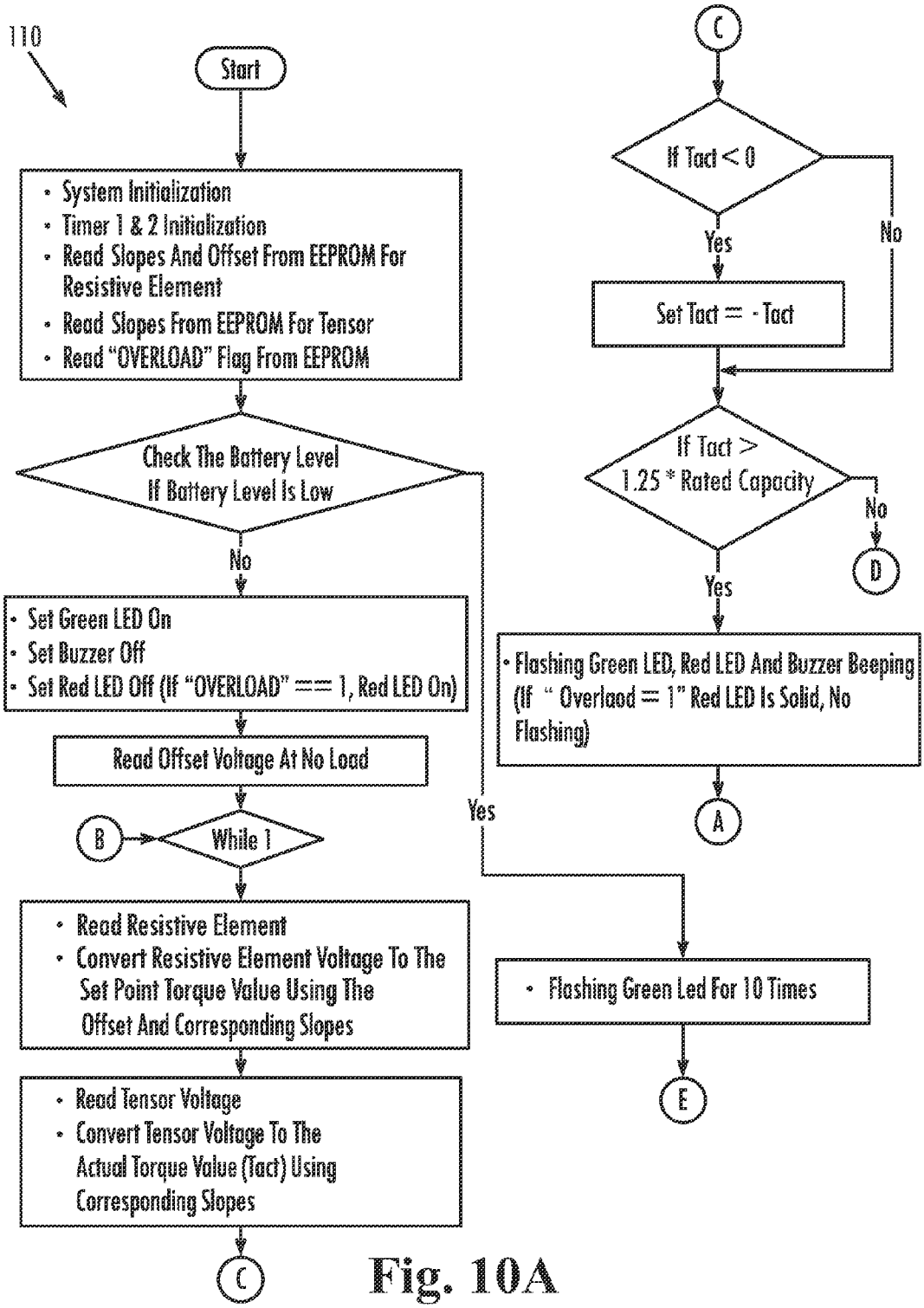
FIGS. 10A and 10B are a flow chart of the control algorithm of the electronic torque wrench as shown in FIG. 1.
Figure 10B:
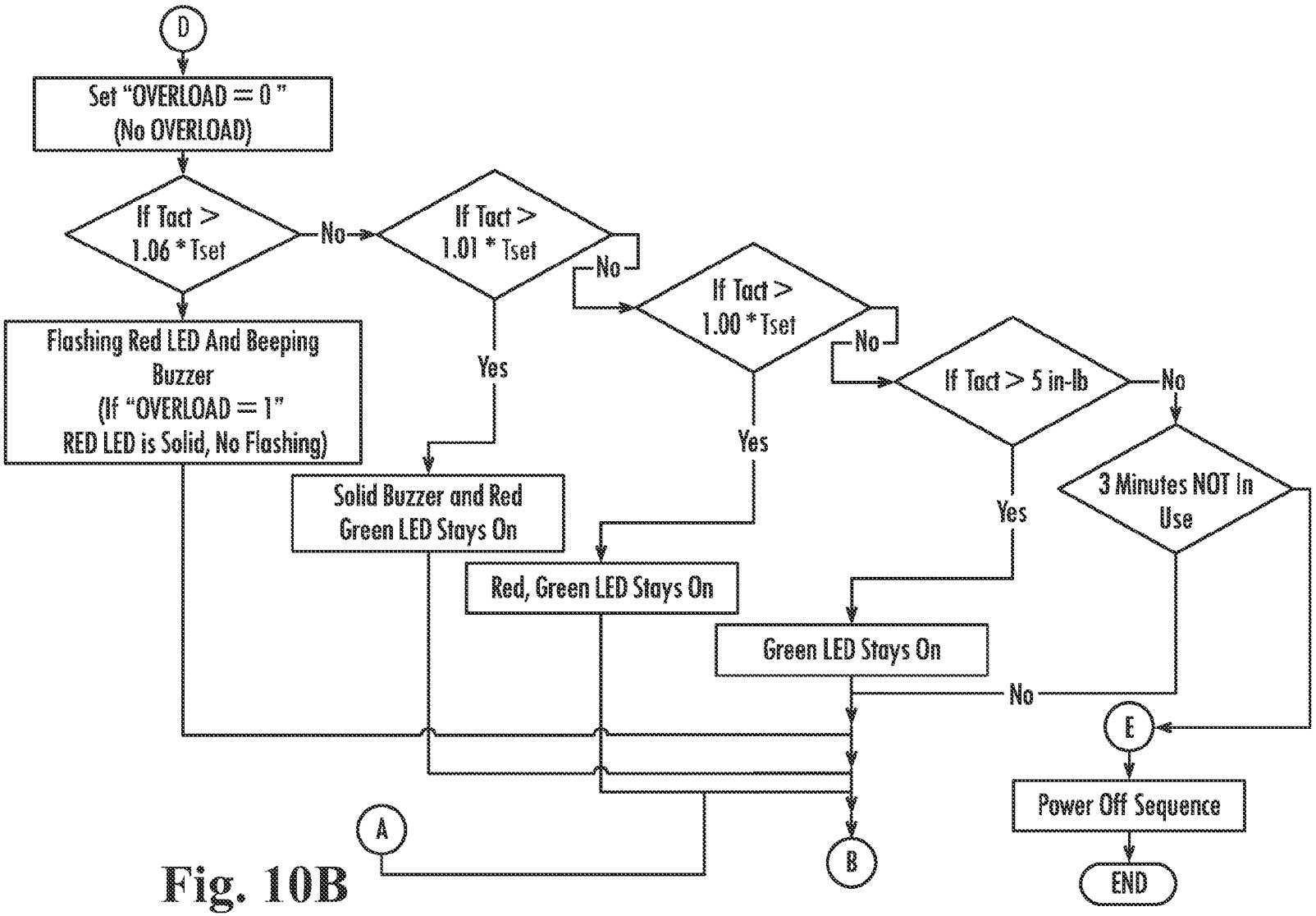

The analog output voltage 67*a* from sensor electrical circuit 67 is converted to an equivalent digital value by an analog to digital converter and is then fed to a microcontroller 63 (for example, Model No. ADuC843 manufactured by Analog Devices, Inc.). A control algorithm 110 (FIGS. 10A and 10B) residing in microcontroller 63 converts the equivalent digital value into an equivalent set point torque value. A unit conversion algorithm converts the torque value to the units indicated on graduated panel 74 of resistive element assembly 66, in the present case inch-pounds and Newton-meters. The choice of units can be increased to cover all possible units by changing the appropriate algorithms, and changing the units shown on graduated panel 74 of resistive element assembly 66.

When electronic torque wrench 10 is used to apply torque, the strain gauges of the strain tensor sense the actual torque applied and send a proportional electrical signal 42*a* to a strain gauge signal conditioning unit 45 that amplifies the signal, and adjusts for any offset of the signal. Adjusting for the offset of the signal increases the accuracy of the wrench by compensating the signal for any reading that may be present before torque is actually applied to the fastener. An amplified and conditioned electrical signal 45*a* is then fed to microcontroller 63 that compares electrical signal 45*a* to electrical signal 67*a* that corresponds to the desired set point torque value to determine if the current torque level value is within a pre-selected range of the set point torque value. Furthermore, microcontroller 63 generates alarm signals in the form of audio signals and light displays of appropriate color once the current actual torque value is within the pre-selected range of the preset set point torque value, as discussed in greater detail hereafter.

Referring now to FIGS. 8, 9, 10A and 10B, a flow chart of the algorithm 110 used with the electronics unit is shown. Prior to initiating torquing operations, the control system of the present invention allows for calibration of the wrench. To initially calibrate the torque wrench, the voltage output signals 45*a* and 67*a* of strain gauge signal conditioning unit 45 and sensor electrical circuit 67, respectively, are measured for two known torque values. Because the values of the two voltage output signals 45*a* and 67*a* are known to correspond to the two known torque values, the "slope" of the voltage output of the strain gauge signal conditioning unit 45 and the sensor electrical circuit 67 with regard to the potential range of set point torque values can be calculated. These slopes are then recorded into the memory of microcontroller 63.

To initiate torquing operations, a user manually inputs a set point torque value using an analog input device into the electronic torque wrench that equals the maximum desired torque to be applied. As seen in FIG. 1, the user slides input slider 76 along graduated panel 74 of resistive element assembly 66 to select the desired set point torque value. Note, the user may set the desired set point torque value either prior to, or after, powering on the electronic torque wrench. However, the torque wrench should be powered on using operating switch 60 prior to actually applying torque.

When powered on, the electronics unit goes through various system initialization processes. For example, the slopes and offset for the resistive element are retrieved from the memory of microcontroller 63 as are the slopes for the strain tensor. Additionally, the electronics unit also reads from memory whether or not the electronic torque wrench was subjected to an overload condition during previous uses. The electronics unit determines whether or not the battery level is sufficient for proper operation of the electronic torque wrench. If not, microcontroller 63 causes green LED 62 to flash ten times prior to initiating a power off sequence for the wrench. If the battery level is deemed adequate for proper operation, microcontroller 63 switches green LED 62 on continuously, sets the enunciator buzzer to off, and sets red LED 64 to off, unless a previous overload condition was determined to have existed, in which case red LED 64 is switched to continuously on. As well, microcontroller 63 reads an offset voltage value for the strain tensor in the no-load condition.

As previously noted, electronic signal 67*a* from sensor electrical circuit 67 is read by microcontroller 63 and converted to the set point torque value utilizing the aforementioned slopes and offset values from memory. As torque is applied with the wrench, microcontroller 63 converts electrical signal 45*a* provided by the strain tensor into an actual torque value (Tact) that is being applied by the electronic torque wrench by using the aforementioned slope values.

Next, microcontroller 63 ensures that the actual torque value (Tact) is a positive value so that it can be compared to the set point torque value (Tset). If microcontroller 63 determines that the actual torque value exceeds 125% of the rated capacity of the torque wrench, the microcontroller causes green LED 62 and red LED 64 to flash and annunciator 56 buzzer to activate. This condition continues until the actual torque value is reduced to less than 125% of rated capacity. If the actual torque value being applied is less than 125% of rated capacity, microcontroller 63 sets its memory to reflect that no overload condition currently exists.

As torque is applied by the wrench, microcontroller 63 continuously switches green LED 62, red LED 64 and annunciator 56 on or off depending on the actual torque value applied by the wrench up until that time. Preferably, green LED 62 remains in a steadily on condition as long as the actual torque value remains below 125% of the torque wrench's rated capacity. If the actual torque value exceeds 106% of the set point torque value, microcontroller 63 causes red LED 64 to begin flashing and activates annunciator 56, in addition to maintaining green LED 62 in a continuously on condition. If the actual torque value is less than 106% of the set point torque value, yet greater than 101% of the set point torque value, microcontroller 63 causes green LED 62 and red LED 64 to remain in a continuously on condition, and causes annunciator 56 to buzz continuously. If the actual torque value is determined to be less than 101% of the set point torque value yet greater than 100% of the set point torque value, microcontroller 63 causes green LED 62 and red LED 64 to remain in a continuously on condition, while annunciator 56 remains silent.

For actual torque values that are less than the set point torque value yet greater than five inch-lbs of torque, microcontroller 63 causes green LED 62 to remain in a continuously on condition. For actual torque values that are less than five inch-lbs., microcontroller 63 initiates a timing sequence in which the electronic torque wrench will go through a power off sequence if it is determined that the actual torque value being applied is less than five inch-lbs for three minutes. By keeping track of the activity of the torque wrench, the algorithm prevents inadvertently draining the batteries.

Figure 11:
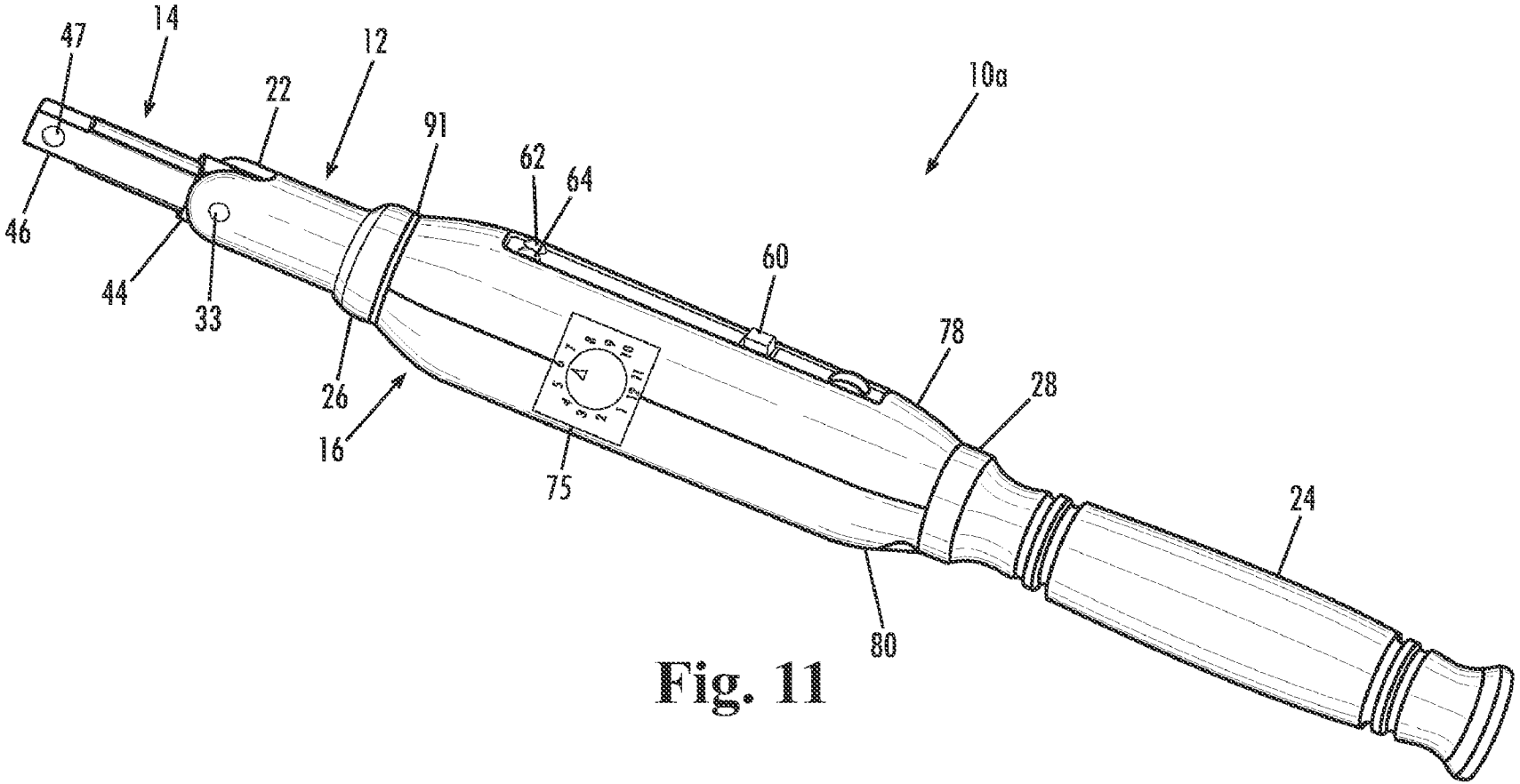
FIG. 11 is a perspective view of an alternate embodiment of an electronic torque wrench in accordance with the present invention.

While one or more preferred embodiments of the invention are described above, it should be appreciated by those skilled in the art that various modifications and variations can be made in the present invention without departing from the scope and spirit thereof. For example, as seen in FIG. 11, an alternate embodiment of an electronic torque wrench 10*a* in accordance with the present invention includes a graduated knob 75 as the analog mechanical input device for selecting a set point torque value, rather than a linear resistor as previously discussed. It is intended that the present invention cover such modifications and variations as come within the scope and spirit of the appended claims and their equivalents.

What is claimed is:

1. A torque wrench, said torque wrench comprising:

a drive member having a surface configured to attach to a work piece to transfer torque to the work piece;

a handle attached to the drive member so that force applied to the handle transfers torque to the drive member;

a transducer disposed operatively between the handle and the drive member so that the transducer senses the torque transferred from the handle to the drive member and outputs a first signal corresponding to the transferred torque sensed by the transducer;

an analog, mechanical input device disposed on the handle that simultaneously defines a set point and indicates the set point;

a comparator that receives the first signal from the transducer, that receives the set point, that compares the first signal from the transducer to the set point, and that outputs a second signal based on a predetermined relationship between the first signal and the set point; and a detection mechanism that receives the second signal from the comparator and that generates a human recognizable output in response to the second signal, wherein the mechanical input device does not display a real time measurement of the torque transferred to the work piece prior to reaching the set point.

2. The torque wrench as in claim 1, wherein the comparator includes a first analog to digital converter that receives the first signal and converts it to a first digital signal, a second analog to digital converter that receives the set point and converts it to a set point digital signal, and a digital microcontroller that receives the first digital signal from the first analog to digital converter, receives the set point digital signal from the second analog to digital converter, and outputs the second signal to the detection mechanism.

3. The torque wrench as in claim 1, wherein the analog, mechanical input device further comprises a potentiometer.

4. The torque wrench as in claim 3, wherein the potentiometer is a linear slide potentiometer.

5. The torque wrench as in claim 3, wherein the potentiometer is an annular potentiometer.

6. The torque wrench as in claim 1, wherein the drive member and the handle are portions of a unitary body.

7. A torque wrench, said torque wrench comprising:

a drive member having a surface configured to attach to a work piece to transfer torque to the work piece;

a handle attached to the drive member so that force applied to the handle transfers torque to the drive member;

a transducer disposed operatively between the handle and the drive member so that the transducer senses the torque transferred from the handle to the drive member and outputs a first signal corresponding to the transferred torque sensed by the transducer;

a variable output circuit that outputs a set point signal corresponding to a desired set point, the variable output circuit including a hand-actuable control that simultaneously defines the set point signal and indicates the desired set point;

a comparator that receives the first signal from the transducer, that receives the set point signal, that compares the first signal from the transducer to the set point signal, and that outputs a second signal based on a predetermined relationship between the first signal and the set point signal; and a detection mechanism that receives the second signal from the comparator and that generates a human recognizable output in response to the second signal.

8. The torque wrench as in claim 3, wherein the hand-actuable control further comprises a potentiometer.

9. The torque wrench as in claim 3, wherein the potentiometer is a linear slide potentiometer.

10. The torque wrench as in claim 3, wherein the potentiometer is an annular potentiometer.

11. The torque wrench as in claim 1, wherein the drive member and the handle are portions of a unitary body.

* * * * *

UNITED STATES PATENT AND TRADEMARK OFFICE

CERTIFICATE OF CORRECTION

PATENT NO. : 8,201,464 B2
APPLICATION NO. : 12/552439
DATED : June 19, 2012
INVENTOR(S) : M. Anjanappa et al.

It is certified that error appears in the above-identified patent and that said Letters Patent is hereby corrected as shown below:

On the Title Page, below Item (54) please change "(76) Inventors:" to --(75) Inventors:--.

On the Title Page, please include the Assignee and insert --Easco Hand Tools, Inc. (Simsbury, CT)--.

In the Specification

Background of the Invention, column 1, line 56, please change "under-torquing" to --under-torqueing--.

Detailed Description of the Preferred Embodiments, column 6, line 6, please change "torquing" to --torqueing--.

Detailed Description of the Preferred Embodiments, column 6, line 18, please change "torquing" to --torqueing--.

Signed and Sealed this
Ninth Day of September, 2014

Michelle K. Lee

Michelle K. Lee
*Deputy Director of the United States Patent and Trademark Office*